United States Patent [19]

Langen et al.

[11] 4,106,940

[45] Aug. 15, 1978

[54] LIGHT-SENSITIVE MATERIAL CONTAINING EMULSIFIED SUBSTANCES

[75] Inventors: Hans Langen, Bonn; Erwin Ranz, Leverkusen; Johannes Eibl, Burscheid-Kaltenberg; Walther Wolf, Leverkusen, all of Fed. Rep. of Germany

[73] Assignee: AGFA-Gevaert, A.G., Leverkusen, Fed. Rep. of Germany

[21] Appl. No.: 619,229

[22] Filed: Oct. 3, 1975

[30] Foreign Application Priority Data

Oct. 3, 1974 [DE] Fed. Rep. of Germany ..... 2447175

[51] Int. Cl.[2] ..... G03C 3/00; G03C 1/52; G03C 1/34; G03C 1/40

[52] U.S. Cl. ..... 96/74; 96/76 R; 96/109; 96/100 R

[58] Field of Search ..... 96/74, 68, 100, 109, 96/76 R

[56] References Cited

U.S. PATENT DOCUMENTS

| | | | |
|---|---|---|---|
| 3,161,512 | 12/1964 | Greenholgh | 96/74 |
| 3,278,306 | 10/1966 | Greenholgh | 96/74 |
| 3,328,419 | 6/1967 | Anderson | 96/74 |
| 3,383,214 | 5/1968 | Anderson | 96/74 |
| 3,713,833 | 1/1973 | Lindholm et al. | 96/94 |
| 3,936,303 | 2/1976 | Shiba et al. | 96/74 |
| 3,957,491 | 5/1976 | Ohi et al. | 96/109 |

*Primary Examiner*—Edward C. Kimlin
*Assistant Examiner*—Louis Falasco
*Attorney, Agent, or Firm*—Connolly and Hutz

[57] ABSTRACT

A light-sensitive material containing in emulsified form photographic additives and a process for introducing these photographic additives in emulsified form into photographic hydrophilic colloid layers with at least one N-alkylphtalimide derivative of the formula

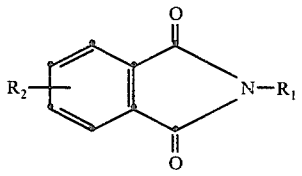

in which $R_1$ and $R_2$ are as defined hereinafter; the material having improved stability properties.

3 Claims, No Drawings

LIGHT-SENSITIVE MATERIAL CONTAINING EMULSIFIED SUBSTANCES

This invention relates to a process for the introduction of substances into photographic layers, in particular for the introduction of couplers into silver halide emulsion layers, and to a light-sensitive photographic material with improved properties which has been prepared by this process.

It is known that emulsifiable compounds such as couplers, ultra violet absorbents, white toners and similar additives can be introduced into gelatine solutions or directly into water with the aid of so-called oil formers, if indicated with the addition of wetting agents. According to U.S. Pat. No. 2,322,027 and No. 2,533,514 for example, colour couplers are incorporated in water-soluble photographic colloids by dissolving the colour couplers in a water-insoluble organic solvent which has a relatively high boiling point, if indicated with the addition of a low boiling auxiliary solvent, and then emulsifying or dispersing the solution in the photographic emulsion.

This method has the disadvantage that some developers, in particular hydrophilic developers, for example those based on N-butyl-N-Δ-sulphobutyl-p-phenylenediamine, cannot penetrate the oil droplets or only to a slight extent. A loss in sensitivity, flattening of the graduation and reduced image density therefore result. On the other hand, hydrophobic developers are liable to be retained in the droplets and causes fogging when the photographic material is treated in oxidizing bleaching baths.

Hydrophilic substances such as colour couplers which are capable of giving rise to an enolate form or which contain sulpho or carboxyl groups can be introduced into the hydrophilic colloid solution as direct solutions or as solutions of their sodium salts. Since the colloid solutions are generally subsequently adjusted to a pH of 6.2 to 6.5, the hydrophilic substances are liable to precipitate or crystallise in this slightly acid pH range. Sensitivity, gradation and the brilliance of the colours are thereby harmfully affected in a way which cannot be controlled. The use of lithium salts and increased quantities of wetting agents also fail to provide any significant improvement. Moreover, some of the hydrophilic substances from the above mentioned group have the effect of increasing the viscosity of the casting solution, in some cases to a considerable extent, so that the solutions are then difficult to handle.

In an alternative method, emulsifiable compounds are dissolved in a volatile solvent which is substantially immiscible with water, such as ethyl acetate, diethylcarbonate, methylene chloride or chloroform, and the resulting solution is then dispersed in the form of extremely fine droplets in an aqueous, light-insensitive, hydrophilic, colloidal medium, in particular in aqueous gelatine, in the presence of a wetting or dispersing agent, whereupon the solvent is evaporated off or broken up after it has solidified and is then washed out with water while the light-insensitive hydrophilic colloid which contains the dispersed compounds is mixed with the casting solution, for example a silver halide emulsion. This method, however also involves certain difficulties. The removal of solvent from the light-insensitive hydrophilic colloid may be difficult and, if a certain amount of solvent is left in the gelatine, it may cause the dispersed fine droplets to agglomerate or crystallize.

This is particularly troublesome in emulsion layers which contain colour couplers in a dispersed form since crystallization of the coupler and agglomeration of the droplets are liable to lead to a flattening of the gradation because the action of the oxidized colour developer on the oil droplets which contain coupler is thereby impaired.

Another problem which has not yet been satisfactorily solved in practice is that the substances incorporated in light-sensitive materials, in particular colour couplers and the dyes produced from them, must be sufficiently stable to light, elevated temperature and moisture when the photographic materials comtaining them are stored for a long time either before or after exposure and before or after they have been processed. Furthermore, the substances must be sufficiently resistant to gaseous or dissolved reducing or oxidizing agents.

In practice, the presence of harmful agents which may considerably reduce the stability of the colour couplers or of the dyes produced from them or of the silver halide emulsion layer cannot always be completely avoided in the preparation of photographic materials and their storage. Moreover, in many cases it has not yet been completely established what factors reduce the stability of a colour coupler or of the dye produced from it or of the silver halide emulsion in an individual case.

It has also been observed that photographic materials in which the additives such as couplers, for example, have been dispersed with the aid of oil formers are more stable to the above mentioned harmful influences then similar materials in which the couplers, for example, are contained in a soluble form. It may therefore be assumed that the hydrophilic oil droplets inhibit the action of harmful agents. Nevertheless, the stability of the above mentioned additives is not sufficient for practical purposes even if they are introduced into the photographic material with the aid of oil formers, particularly if the photographic materials are stored under moist, warm conditions before or after exposure, for example at 60° C and 98% humidity.

It is therefore an object of this invention to provide a photographic recording material with improved properities in which at least one photographic layer contains a heterogeneous distribution of emulsified substances, in particular colour compounds, which have been emulsified in the usual manner. The emulsified couplers of the recording material should be highly sensitive and reactive and should not cause troublesome fogging and the couplers and dyes produced from them should have sufficient stability to light without the photographic properties of the silver halide emulsion or its viscosity or casting properties being deleteriously affected.

It has now been found that the problem defined above can be solved highly satisfactorily by introducing the photographic additives, in particular colour compounds into the photographic layers with the aid of N-alkyl-phthalimide compounds of the formula indicated below which are used as oil formers in known manner.

This invention therefore relates to a light-sensitive material with at least one silver halide emulsion layer, in which material at least one hydrophilic colloid layer contains at least one photographic additive which is emulsified in the hydrophilic layer in known manner as a mixture with an oil former which is substantially insoluble in water, the said oil former being a N-alkylphthalimide derivative of the following formula, which may be substituted:

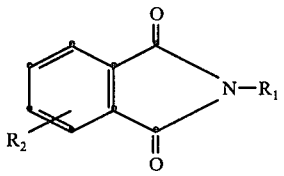

$R_1$ represents a cycloalkyl group which may be substituted by alkyl, alkoxy or halogen, a branched chain alkyl group proferably containing 3 to 18 carbon atoms, more preferably a secondary alkyl group, in which the secondary carbon atom is attached to the nitrogen atom, or straight chain or branched chain alkyl group which preferably contains a total of 2 to 18, more preferably 2 to 8 carbon atoms and which is substituted by halogen, hydroxyl, acyloxy, carboxyl, or alkoxycarbonyl, and which the carbon chain may be substituted by carbonyl oxygen or may be interrupted by oxygen atoms and $R_2$ represents hydrogen or halogen or a hydroxyl, preferably $C_1$ to $C_4$ alkoxy, carboxyl, preferably $C_1$ to $C_4$ alkoxy carbonyl or phenyl group.

The invention also relates to a process for emulsifying photographic additives which are insoluble or only sparingly soluble in water in a hydrophilic phase which may contain a colloid, the photographic additive being dissolved in a mixture of a low boiling solvent which has a boiling point of at the most 130° C and at least one of the N-alkylphthalimides of the above formula which may be substituted, and the resulting solution being emulsified in the hydrophilic phase in known manner in the presence of a wetting agent, and the low boiling solvent being thereafter practically completely removed so that a mixture of the photographic additive and the substituted or unsubstituted N-alkylphthalimide of the above formula which functions as oil former is left uniformly distributed in the hydrophilic phase. It is particularly advantageous to use mixtures of N-alkylphthalimides of the above formula in accordance with the invention. If desired, the oil formers of the above formula may also be mixed with N-alkylphthalimides with straight chain alkyl groups.

The process according to the invention makes it possible for photographic additives to be distributed very uniformly in an emulsion. It is particularly advantageous for the introduction of hydrophilic couplers into silver halide gelatine emulsions. The couplers are generally dissolved in the oil former with the addition of a low boiling solvent which is substantially immiscible with water, such as ethyl acetate or diethylcarbonate, and the resulting solution is then added to the hydrophilic phase. The hydrophilic phase may be an aqueous solution, an aqueous gelatine solution or a photographic emulsion mixture containing the necessary additives.

If an aqueous solution or aqueous gelatine solution is used as the hydrophilic phase into which coupler compounds are required to be emulsified, these mixtures can easily be added to a finished photographic emulsion mixture or alternatively the couplers, emulsified in an aqueous gelatine solution in accordance with the invention, may be used directly as photographic casting solution if it is intended to accommodate the couplers in an intermediate layer.

The oil formers used according to the invention are known per se and have been described, for example, in the surveys given by Beilstein in Vol. 18 and in Supplementary volumes I and II. The oil formers of the above formula are generally readily crystallised substances with melting points of from 50° to 150° C. It was therefore surprising to find that compounds of the above formula, either singly or in combination with each other or in combination with N-alkylphthalimides which have straight alkyl chains are excellent coupler solvent mixtures which are eminently suitable for use as high boiling coupler solvents so that very stable emulsions can be obtained by the process according to the invention.

It has not yet been clarified in what form the photographic additives in the oil formers according to the invention exist in the hydrophilic colloid layer. It may be assumed that they constitute pure or hypersaturated solutions or supercooled melts with the oil formers.

The N-alkylphthalimides may be used as any mixtures. If two compounds of the above formulae are used, for example, it is suitable to mix them in proportions of 1:4 although preferably a 1:1 mixture or corresponding eutectic mixture is used. It is particularly advantageous to use combinations of N-alkylphthalimides in which at least two of the compounds have a melting point below 65° C. If only one N-alkylphthalimide of the above formula is used on its own, it is also preferably to select one which has a melting point below 65° C.

The compounds used according to the invention have the advantage that, apart from having a very pronounced crystallization inhibiting effect, especially on emulsified colour couplers, they do not inhibit coupling of the colour couplers with the oxidized colour developer. The sensitometric properties can also be varied as desired with the aid of the oil formers, according to the polarity of the chosen substituents on the phthalimide nitrogen atom.

The following examples illustrate the advantageous use of hydrophilic and hydrophobic developers. The oil formers used according to the invention are generally washed out only to a negligible extent even when short chain alkyl groups with only 2 to 3 carbon atoms are used. Precipitation of the dye produced by development and the occurrence of unequal colour densities in areas of the colour image in which areas of equal colour densities are expected to be reproduced can therefore advantageously be prevented.

Table I below gives examples of suitable compounds which may be used according to the invention.

TABLE 1

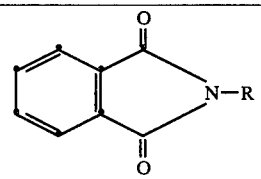

| Compound | R | m.pt. [° C] |
|---|---|---|
| 1 | $CH_3$ | 132 |
| 2 | $C_2H_5$ | 79 |
| 3 | n-$C_3H_7$ | 66 |
| 4 | iso-$C_3H_7$ | 85 |
| 5 | n-$C_4H_9$ | 32 |
| 6 | sec-$C_4H_9$ | 24 |
| 7 | iso-$C_4H_9$ | 92 |
| 8 | iso-$C_5H_{11}$ | 12.5 |
| 9 | $-CH_2(CH_3)-C_3H_7$ | 23 |
| 10 | n-$C_6H_{13}$ | 37 |
| 11 | n-$C_8H_{17}$ | 48 |
| 12 | $CH_2-O-CH_3$ | 120 |

TABLE 1-continued

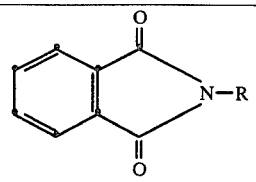

| Compound | R | m.pt. [° C] |
|---|---|---|
| 13 | $CH_2—O—C_2H_5$ | 88 |
| 14 | $CH_2—O—C_3H_7$ | 52 |
| 15 | $CH_2—O—iso-C_3H_7$ | 93 |
| 16 | $C_2H_4—O—CH_3$ | 113 |
| 17 | $C_2H_4—O—C_2H_5$ | 63 |
| 18 | $C_2H_4—O—C_3H_7$ | 73 |
| 19 | $C_2H_4—O—iso-C_3H_7$ | 62 |
| 20 | $C_2H_4—O—C_4H_9$ | liquid |
| 21 | $C_2H_4—O-iso-C_4H_9$ | 49 |
| 22 | $C_2H_4—O-sec.-C_4H_9$ | 58 |
| 23 | $C_2H_4—O—C_5H_{11}$ | 132 |
| 24 | $C_2H_4—O-iso-C_5H_{11}$ | liquid |
| 25 | $(CH_2)_3—O—CH_2—CH(C_2H_5)—C_4H_9$ | liquid |
| 26 | $C_2H_4—O—CO—C_2H_5$ | 60 |
| 27 | $C_2H_4—COOC_5H_{11}$ (iso) | 61 |
| 28 | $C(CH_3)_2—COOCH_3$ | 78 |
| 29 | $n-C_5H_{10}—COOH$ | 108 |
| 30 | $C_3H_6—COOCH_3$ | 64 |
| 31 | $C_3H_6—COOC_2H_5$ | 44 |
| 32 | $C_6H_{12}—COOCH_3$ | 50 |
| 33 | $C_6H_{12}—COOH$ | 115 |
| 34 | $C(CH_3)_2—COCH_3$ | 105 |
| 35 | $C(CH_3)_2—COC_2H_5$ | 70 |
| 36 | $iso-C_4H_8OH$ | 106 |
| 37 | $C_2H_4—OH$ | 126 |
| 38 | $C_2H_4—Cl_{(\beta)}$ | 79 |
| 39 | $C_2H_3Cl_2$ | 94 |
| 40 | $C_3H_6Br(\gamma)$ | 72 |
| 41 | $C_3H_6I(\gamma)$ | 89 |
| 42 | $iso-C_4H_8Br(\zeta)$ | 80 |
| 43 | $n-C_4H_8I(\zeta)$ | 88 |
| 44 | $n-C_5H_{10}—Cl_{(\epsilon)}$ | 30 |
| 45 | $C_2H_4—O—C_2H_4Cl_{(\beta)}$ | 69 |
| 46 | 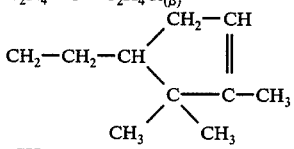 | 54 |
| 47 | 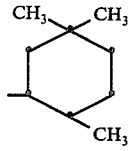 | liquid |

Particularly advantageous results can be obtained according to the invention by using at least one N-alkylphthalimide which contains a secondary alkyl group with 3 to 18 carbon atoms, preferably 3 to 8 carbon atoms, an alkylsubstituted cycloalkyl group, an alkoxycarbonylsubstituted alkyl group with 2 to 8 carbon atoms or an alkyl group with 2 to 18 carbon atoms interrupted by ether oxygen atoms.

The compounds may be prepared by the methods known from the literature. Suitably substituted or unsubstituted anhydrous alkylamines or akylamine mixtures are generally introduced into molten phthalic acid anhydride and the reaction product is then used according to the invention, either directly or after purification by distillation.

The compounds may also be prepared by reacting anhydrous alkylamine or an alkylamine mixture with phthalic acid anhydride at elevated tempratures, using a high boiling solvent such as dichlorobenzene. The product is then purified by fractional distillation.

If N-alkylamine mixtures are used, the resulting N-alkylphthalimide mixture is generally obtained directly as an oil which is difficult to crystallise. The N-alkylphthalimide mixture generally requires no further purification before it is used for the purpose of the invention if it has been prepared by the last mentioned method. Propionyloxyalkylphthalimides, for example, can be obtained by reacting phthalic acid anhydride in propionic acid anhydride with hydroxyethylamine, if desired in the presence of dichlorobenzene as solvent. Further addition of propionic acid anhydride results in the formation of the desired ester via the hydroxyalkylphthalimide stage.

Suitable N-alkylphthalimide mixtures include, for example, a 3:2 mixture of N-n-butylphthalimide with N-ethoxy-carbonylethylphthalimide; a 1:1 mixture of 3,3,5-a-trimethyl-cyclohexylphthalimide with its stereoisomer 3,3,5-e-triethyl-cyclohexylphthalimide, a 0.4:0.6:1.0:2 mixture of N-ethylphthalimide, N--n-propylphthalimide, N-sec.-butyl-phthalimide and N-n-butylphthalimide or a 1:1 mixture of 1,6-bis-phthalimido -2,2,4-trimethylhexane with 1,6-bis-phthalimido-2,4,4-trimethyl-hexane.

The last mentioned mixture of isomers is prepared by the method described in German Offenlegungsschrift No. 2,008,112. The refractive index is practically the same as that of dry gelatine so that no opalescence occurs. Another advantage of the process according to the invention is that the N-alkylphthalimides have a specific gravity which is practically equal to that of water or only slightly higher. Very stable emulsions suitable for various emulsifiable substances can therefore be obtained by using suitable combinations of variously substituted N-alkylphthalimides according to the invention. It is therefore possible to prevent agglomeration or an accumulation of droplets of emulsion on the surface or at the bottom of the vessel if the emulsion is left to stand for a long time. The compounds used according to the invention in no way impair the sensitivity of colour coupler compounds in the emulsion or their stability under conditions of moist or dry heat. The stability of the dye also is in no way harmfully affected by the process according to the invention. The photographic images produced by the process according to the invention have a very intense colour and fine grain and are virtually free from any signs of crystallisation or agglomeration.

The tendency to crystallisation of the photographic additives which are to be emulsified is effectively suppressed so that even substances which normally crystallise very readily can be emulsified without recrystallisation occurring.

It is also surprisingly found that the basic fog of photographic materials is lower than in materials in which known compounds such as dibutylphthalate are used for emulsification. The residual coupler of the chromogenically processed materials, in particular the magenta coupler, is also more stable to the action of sunlight than in similar materials containing one of the previously mentioned oil formers dibutylphthalate or tricresylphosphate instead of the compound according to the invention. Yellowing which normally occurs is therefore substantially reduced according to the invention.

The oil formers are generally used in proportions of from 0.1 to 10 parts by weight for each part by weight of the substance which is to be incorporated, the preferred range being from 0.3 to 1 part by weight. Higher cencentrations of up to 10 parts by weight are interesting for cases in which only minor quantities of an additive, e.g. a stabilizer, should be introduced into the casting solution.

Part of the oil formers used according to the invention may, of course, be replaced by other, conventional oil formers such as dibutylphthalate but these are preferably not used in quantities of more than 50% of the required oil former.

The usual low boiling solvents which are insoluble or only slightly soluble in water may be used as auxiliary solvents. Examples of particularly suitable organic solvents which are immiscible with water include chlorinated short chain aliphatic solvents e.g. methylene chloride or ethylene acetate, formates such as ethyl formate, ketones such as methyl-n-propyl ketone, ethers such as diisopropylether, cyclohexane, toluene and diethyl carbonate.

The light-sensitive emulsions used may be emulsions of silver halides such as silver chloride, silver bromide or mixtures thereof, if desired with a small silver iodide content of up to 10 mols %, incorporated in one of the usual hydrophilic binders.

The binder used for the photographic layers is preferably gelatine which may, however be partly replaced by other natural or synthetic film forming polymers, e.g. alginic acid and its derivatives such as its salts, esters or amides, carboxymethylcellulose, alkylcellulose, starch and its derivatives, polyvinyl alcohol, copolymers containing vinyl alcohol and vinyl acetate units, polyvinylpyrrolidone and the like, anionic polyurethanes and other latices, e.g. copolymers of acrylic esters, acrylonitrile and acrylamide.

The light sensitive emulsions may be chemically ripened in the presence of small quantities of sulphur compounds such as allylisothiocyanate, allylthiourea or sodium thiosulphate. The light sensitive emulsions may also be sensitized with the tin compounds described in Belgian Pat. No. 493,464 and No. 568,687 or with polyamides such as diethylenetriamine or the iminoaminomethane sulphinic acid compounds described in Belgian Pat. No. 547,323 or small quantities of noble metal compounds such as compounds of gold, platinum, palladium, iridium, ruthenium or rhodium. This method of chemical sensitization has been described in the article by R. Koslowsky, Z.Wiss.Phot. 46, 65 – 72 (1951). The emulsions may also be sensitized with polyalkylene oxide derivatives, e.g. a polyethylene oxide which has a molecular weight of between 1000 and 20,000 or with condensation products of alkylene oxides and aliphatic alcohols, glycols or cyclic dehydration products of hexitols or alkyl substituted phenols, aliphatic carboxylic acids, aliphatic amines, aliphatic diamines or amides.

The condensation products have a molecular weight of at least 700 and preferably more than 1000. These sensitizers may, of course, be combined to produce special effects as described in Belgian Pat. No. 537,278 and British Pat. No. 727,982.

The emulsions which contain colour couplers may also contain spectral sensitizers, e.g. the usual monomethine or polymethine dyes such as cyanines, hemicyanines, streptocyanines, merocyanines, oxonols, hemioxonols, styryl dyes or others, including also trinuclear or higher nuclear methine dyes, for example rhodacyanines or neocyanines. Sensitizers of this kind have been described, for example, in the work by F. M. Hane entitled "The Cyanine Dyes and Related Compounds" (1964), Interscience Publishers John Wiley and Sons, New York.

The emulsions may contain the usual stabilizers, e.g. homopolar compounds or salts of mercury which contain aromatic or heterocyclic rings such as mercaptotriazoles, simple mercury salts, sulphonium mercury double salts or other mercury compounds. Azaindenes are also suitable stabilizers, particularly tetra- or pentaazaindenes and especially those which are substituted with hydroxyl or amino groups. Compounds of this kind have been described in the article by Birr, Z.Wiss.Phot. 47, 2 – 27 (1958). Other suitable stabilizers include heterocyclic mercapto compounds, e.g. phenylmercaptotetrazole, quaternary benzothiazole derivatives and benzotriazole.

The emulsions may be hardened in the usual manner, for example with formaldehyde or halogenated aldehydes which contain a carboxyl group such as mucobromic acid, diketones, methanesulphonic acid ester and dialdehydes.

The photographic layers may also be hardened with epoxide hardeners, heterocyclic ethyleneimine compounds or acryloyl compounds. Examples of such hardeners have been described e.g. in German Offenlegungsschrift No. 2,263,602 and British Pat. Specification No. 1,266,655. The layers may also be hardened by the process according to German Offenlegungsschrift No. 2,218,009 so that colour photographic materials suitable for high temperature processing may be obtained.

The photographic layers or colour photographic multilayered materials may also be hardened with hardeners based on diazine, triazine or 1,2-dihydroquinoline as described in Britist Pat. Specification Nos. 1,193,290; 1,251,091; 1,306,544 and 1,266,655; French Pat. No. 7,102,716 and British Pat. Specification No. 1,452,669 (U.S. Pat. No. 4,013,468). Examples of such hardeners include dyes and derivatives which contain alkyl or aryl sulphonyl groups, derivatives of hydrogenated diazines or triazines, e.g. 1,3,5-hexahydrotriazine, fluorinated diazine derivatives, e.g. fluoropyrimidines, and esters of 2-substituted 1,2-dihydroquinoline- or 1,2-dihydroisoquinoline-N-carboxylic acids. Vinyl sulphonic acid hardeners and carbodiimide or carbamoyl hardeners of the kind described, for example in German Offenlegungsschriften Nos. 2,263,602; 2,225,230 and 1,808,685; French Pat. No. 1,491,807; German Pat. No. 872,153 and DDR Patent No. 7,218 may also be used. Other suitable hardeners have been described, for example, in British Pat. Specification No. 1,268,550.

The process according to the invention may advantageously be employed, for example, for incorporating filter dyes and antihalation dyes in pure gelatine for the purpose of preparing filter layers or antihalation layers, preferably for incorporating colour couplers and compounds which form masks, or for developer substances, sensitizing dyes and stabilizers. The above mentioned compounds are incorporated particularly in light-sensitive silver halide gelatine emulsions of black-and-white or colour photographic materials.

The term "colour coupler" is used in this connection to denote a compound which forms a dye with an oxidized colour developer in silver halide photography. The term "masking compound" is used to represent a compound which reacts with such a colour coupler in an oxidizing bleaching bath (see e.g. British Specification Nos. 880,862 and 975,932) or coloured couplers which split off an azo group under the conditions of chromogenic development. Compounds of this kind are already known and have been described, for example, in U.S. Pat. Specification No. 2,584,349.

The colour photographic materials according to the invention contain the oil formers in at least one photographic emulsion layer which may be any layer of the photographic material and preferably contains a magenta coupler. The oil formers according to the invention may, of course, also be present in more than one photographic emulsion layer. The photographic emulsion layer may be an auxiliary layer, a protective layer, a bonding layer, a silver halide emulsion layer, an intermediate layer or a filter layer. Preferred materials according to the invention contain a diffusion resistant magenta coupler, in particular a pyrazolone magenta coupler according to the invention, incorporated in the green sensitized silver halide emulsion layer.

The materials which may be used according to the invention include, for example, positive, negative or reversal materials with the usual support layers used in known manner for the preparation of photographic materials. Suitable substrates include e.g. foils of cellulose nitrate, cellulose acetate, such as cellulose triacetate, polystyrene, polyesters such as polyethylene terephthalate, polyolefines such as polyethylene or polypropylene, a baryta paper substrate on polyolefine laminated paper substrate e.g. a polyethylene laminated paper substrate or glass.

Suitable wetting agents which may be used according to the invention for incorporating the photographic additives have been described by Gerhard Gewalek in "Wasch- und Netzmittel", Akademie-Verlag Berlin (1962). The following are examples: The sodium salt of N-methyl-oleytauride, sodium stearate, the sodium salt of heptadecenylbenzimidazole sulphonic acid, sodium sulphonates of higher aliphatic alcohols, e.g. 2-methylhexanol-sodium sulphonate, sodium diiso-octyl-sulphosuccinate, sodium dodecylsulphonate and the sodium salt of tetradecylbenzenesulphonic acid.

The colour couplers used according to the invention may be any of the usual colourless compounds which react with oxidation products of colour developer substances to form azomethine or azo dyes. The compounds used as cyan couplers, for example, are generally derivatives of phenol or $\alpha$-naphthol the magenta couplers are generally derivatives of 2-pyrazolinone-5 or indazolone and the yellow couplers are generally derivatives of $\beta$-ketocarboxylic acid derivatives, e.g. of benzoyl acetanilide or pivaloyl acetanilides. The couplers may be unsubstituted in the coupling position, so-called 4-equivalent couplers or couplers which carry a substituent in the coupling position, which substituent is split off in the reaction with the developer oxidation products, so-called 2-equivalent couplers or DIR couplers which split off a development inhibitor. Examples of the usual colour couplers have been described, for example, in the article by W. Pelz in "Mitteilungen aus den Forschungslaboratorien der Agfa Leverkusen-München", Volume 3, page 111.

The usual colour developers are used for producing the dyes, for example the usual aromatic compounds based on p-phenylenediamine which contain at least one primary amino group. Examples of suitable colour developers include, for example, N,N-dimethyl-p-phenylenediamine, N,N-diethyl-p-phenylenediamine, monomethyl-p-phenylenediamine, 2-amino-5-diethylaminotoluene, N-butyl-N-$\omega$-sulphobutyl-p-phenylenediamine and 2-amino-5-(N-ethyl-N-$\beta$-methanesulphonamidoethylamino)-toluene. Other suitable colour developers have been described, for example, in J.Amer.Chem.Soc. 73, 3100 - 3125 (1951).

The invention will now be described with the aid of examples.

EXAMPLE 1

This example shows how a higher final colour density and lower colour fog can be obtained in naphtholic cyan couplers or pyrazolone magenta couplers by using the compound according to the invention as oil former, compared with the use of dibutylphthalate as oil former.

The photographic materials were prepared as follows:

(a) 28 g of the cyan coupler of the following formula

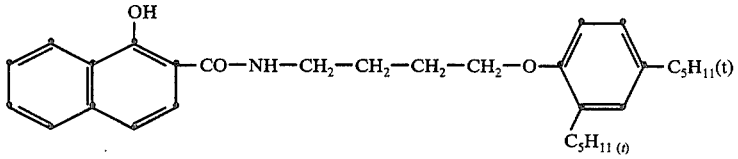

together with 14 g of dibutylphthalate and 2.8 g of sulphosuccinic acid-bis-(2-ethyl)-hexylester were dissolved in 70 ml of ethyl acetate at 55° C and the solution was emulsified in 280 ml of a 10% gelatine solution at the same temperature with a mixing siren. The ethyl ester was subsequently removed in a rotary evaporator and the emulsion was added to 1 kg of a red sensitized silver iodobromide emulsion which contained 0.85 mol of silver halide per kg with a silver halide content of 3% and 70 g of gelatine.

(b) A similar emulsion was prepared to that described under (a) except that secondary pentylphthalimide was used as oil former instead of dibutylphthalate.

(c) 23 g of the following magenta coupler

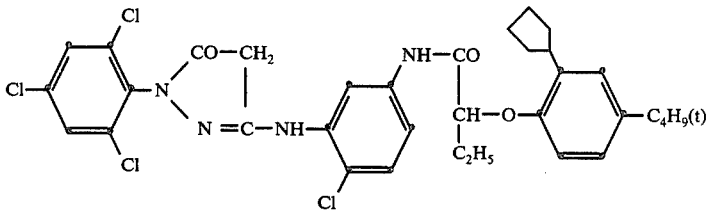

together with 23 g of dibutylphthalate and 46 ml of ethyl acetate were emulsified in 230 ml of a 2.5% gelatine solution which contained 2.3 g of the sodium salt of dodecylbenzenesulphonic acid. After the emulsion had been treated in the usual manner, it was added to a green sensitized silver iodobromide emulsion which contained, per kg of emulsion, 1 mol of silver halide with a silver iodide content of 5% and 75 g of gelatine.

(d) A similar emulsion was prepared to that described under 1 c except that secondary butylphthalimide was used as oil former instead of dibutylphthalate.

Emulsions (a)–(d) prepared as described above were applied to a triacetate foil with a silver application of 0.03 mol per $m^2$. The photographic materials obtained in this way were hardened with a coating of a solution of 1-methyl-3-dimethylaminopropyl-carbodiimide hydrochloride in a 1% gelatine solution and, after exposure behind a grey step wedge, they were developed in a conventional colour developer containing N-ethyl-N-β-hydroxyethyl-3-methyl-p-phenylene diamine at 38° C for 3 minutes and 15 seconds. The samples were assessed in a conventional densitometer. The density and fog values obtained are shown below.

Table 1

| Emulsion sample | S | $D_{max}$ |
|---|---|---|
| (a) | 0.40 | 2.8 |
| (b) | 0.34 | 3.2 |
| (c) | 0.46 | 2.1 |
| (d) | 0.35 | 2.3 |

As the results show, samples (b) and (d) according to the invention are distinguished by a considerable reduction in the basic fog and by an increase in the maximum density compared with the prior art samples (a) and (c).

EXAMPLE 2

This example shows that the advantageous final colour density which can be obtained by using the oil formers according to the invention can be further increased by the addition of a N-alkylphthalimide derivative having even more hydrophilic properties to the N-alkylphtalimide derivative used having slightly lower hydrophilic properties.

(a) 30 g of the following cyan coupler

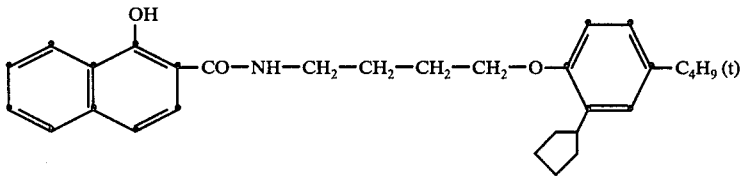

together with 30 g of dibutylphthalate, 3 g of sulphosuccinic acid-bis-(2-ethyl)-hexylester and 60 ml of diethylcarbonate were emulsified in 300 ml of a 5% gelatine solution at 50° C. After the emulsion had been processed in the usual manner it was added to a red sensitized silver iodobromide emulsion which contained, per kg, 1 mol of a silver halide with a silver iodide content of 4% and 75 g of gelatine.

(b) A similar emulsion was prepared to that described under (a) except that secondary butylphthalimide was used as oil former instead of dibutylphthalate.

(c) A similar emulsion was prepared to that described under (b) except that a mixture of n-butylphthalimide and propionyloxyethylphthalimide in proportions by weight of 3:2 was used instead of secondary butyl phthalimide.

(d) 22 g of the following magenta coupler

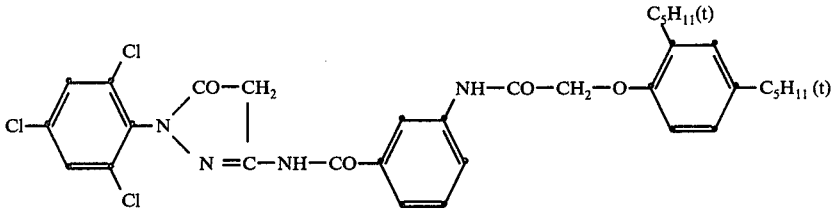

together with 22 g of tricresylphosphate (commercial isomeric mixture) and 44 ml of ethyl acetate were emulsified in 110 ml of a 5% gelatine solution which contained 2.2 g of dodecyl benzene sulphonic acid sodium. After the emulsion had been processed in the usual manner, it was added to a green sensitized silver iodobromide emulsion which contained 4% of iodide and 75 g of gelatine.

(e) A similar emulsion was prepared to that described under (d) except that the isomeric mixture of 3,3,5-trimethylcyclohexylphthalimide was used instead of tricresylphosphate.

(f) 38 g of the following yellow coupler

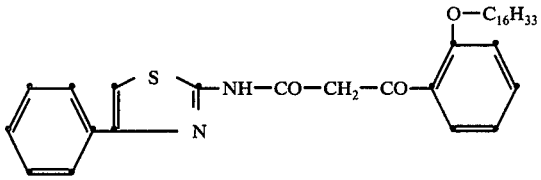

together with 38 g of dibutylphthalate and 76 ml of diethylcarbonate were emulsified in 380 ml of a 5% gelatine in which 3.8 g of dodecylbenzenesulphonic acid sodium were dissolved. After the emulsion had been processed in the usual manner, it was added to 1 kg of a non-sensitized silver bromide emulsion which contained 0.2 mol of silver bromide and 80 g of gelatine per kg.

(g) A mixture similar to that described under (f) was prepared except that propionyloxyethylphthalimide was used instead of dibutylphthalate.

Emulsions (a) – (e) prepared as described above were applied to a triacetate foil as described in Example 1, exposed behind a grey step wedge and developed at 38° C as described in Example 1.

The emulsion samples (f) and (g) were applied to a polyethylene laminated paper substrate with a silver application of 0.014 mol per $m^2$ and hardened with triacryloformal. After exposure behind a grey step wedge, the samples were developed for 5 minutes at 20° C in a conventional colour developer which contained N-butyl-N-γ-sulphobutyl-p-phenylenediamine as colour developer substance.

The samples were assessed as described in Example 1. The density values obtained are shown in Table 2 below.

Table 2

| Emulsion sample | (a) | (b) | (c) | (d) | (e) | (f) | (g) |
|---|---|---|---|---|---|---|---|
| $D_{max}$ | 2.6 | 2.7 | 3.2 | 1.60 | 2.50 | 1.50 | 2.10 |

As can be seen from the results obtained with emulsion samples (c) and (e), an excellent increase in the final colour densities can be obtained by using a mixture of phthalimides according to the invention compared with the results obtained in samples prepared according to the known art, which in the case of sample (d) contained the isomeric mixture of tricresylphosphate and in sample (a) dibutyl phthalate. Emulsion samples (f) and (g) show that the technical advance achieved with the oil formers according to the invention can be demonstrated also when using a paper substrate and a hydrophilic colour developer under normal processing conditions. The higher final colour density is presumably due not least to an increased stability of the emulsion.

EXAMPLE 3

Photographic materials which contain dibutylphthalate or tricresylphosphate as oil formers in accordance with the known art are generally unstable in the presence of sunlight so that their fog values measured behind red or blue filters increase considerably in the unexposed part of a magenta partial image, that is to say yellow or greenish colour tints are obtained. This phenomenon is generally referred to as yellowing.

This example shows that by using the oil formers according to the invention the fogging effects mentioned above can to a large extent be prevented in photographic materials containing pyrazolone couplers.

Preparation of the emulsion:

(a) 15 g of the following magenta coupler

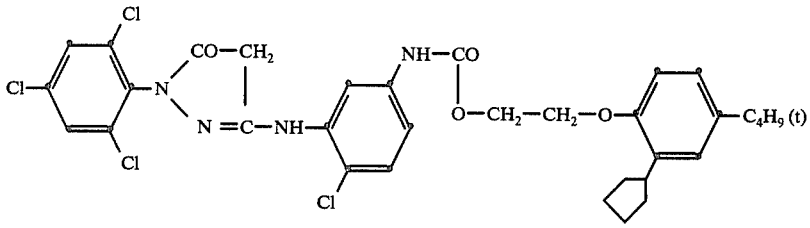

together with 15 g of dibutylphthalate and 50 ml of ethyl acetate were emulsified in 150 ml of a 10% gelatine solution which contained 1.5 g of dodecylbenzenesulphonic acid sodium. The emulsion was then added to 1 kg of a green sensitized silver chlorobromide emulsion which contained 0.2 mol of silver halide and 75 g of gelatine per kg.

(b) A similar sample was prepared to that described under (a) except that tricresylphosphate was used instead of dibutylphthalate.

(c) A similar sample was prepared to that described under (a) except that secondary butylphthalimide was used instead of dibutylphthalate.

(d) A similar sample was prepared to that described under (a) except that the magenta coupler described there was replaced by the following magenta coupler:

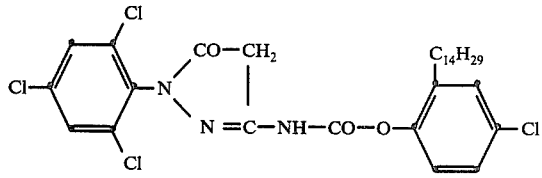

(e) A similar sample was prepared to that described under (d) except that a mixture of ethyl/propyl/sec.-butyl/n-butyl phthalimide in proportions of 0.4:0.6:1.0:2.0 was used instead of dibutylphthalate.

(f) A similar sample was prepared to that described under (d) except that β-ethyl-hexoxypropylphthalimide was used instead of dibutylphthalate.

Emulsions (a) to (f) were applied to a polyethylene laminated paper substrate with a silver application of 7 mMol per $m^2$. The layers were hardened by the addition of 1,3,5-Trisacryloylhexahydro-s-triazin. Samples were exposed behind a grey step wedge and colour development was carried out in a conventional colour developer containing N-butyl-N-γ-sulphobutyl-p-phenylenediamine as colour developer substance.

The colour wedges obtained in this way were halved and each sample was irradiated with $5 \times 10^6$ Lux hours from a Xenon lamp. A comparision of the fog values of the unirradiated and irradiated sample is shown in Table 3 below, in which $S_o$ indicates the fog values of the unirradiated samples behind a blue filter, a green filter or a red filter and $S_I$ indicates the fog values of the irradiated samples behind a blue filter, a green filter and a red filter.

Table 3

| | $S_o$ Filter | | | $S_o$ Filter | | |
|---|---|---|---|---|---|---|
| Emulsion | Blue | Green | Red | Blue | Green | Red |
| (a) | 0.12 | 0.22 | 0.12 | 0.50 | 0.36 | 0.34 |
| (b) | 0.17 | 0.22 | 0.08 | 0.47 | 0.35 | 0.29 |
| (c) | 0.17 | 0.17 | 0.10 | 0.32 | 0.23 | 0.13 |
| (d) | 0.19 | 0.19 | 0.12 | 0.25 | 0.18 | 0.11 |
| (e) | 0.18 | 0.19 | 0.12 | 0.21 | 0.15 | 0.10 |
| (f) | 0.18 | 0.19 | 0.12 | 0.20 | 0.15 | 0.10 |

As can be seen from the results, irradiation with Xenon light has the effect of greatly increasing the fog in comparison samples (a), (b) and (d) whereas in the samples according to the invention (c), (e) and (f) the fog values behind the green and red filter are practically unchanged and the fog values measured beghind the blue filter increase only slightly. The invention therefore achieves a considerable increase in the stability of anilino and acylaminopyrazolones in the photographic layers.

We claim:

1. Light-sensitive photographic material having at least one silver halide emulsion layer and at least one hydrophilic colloid layer containing at least one photographic additive selected from the group consisting of couplers, UV-absorbers, white toners and stabilizers emulsified in the hydrophilic layer as a mixture with at least one oil former which is substantially insoluble in water the improvement according to which the oil former is at least one compound of the formula

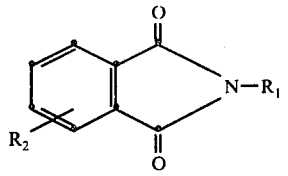

in which $R_1$ represents a group consisting of a cycloalkyl group, a secondary alkyl group containing 3 to 8 carbon atoms, an alkoxy carbonyl substituted alkyl group containing 2 to 8 carbon atoms and an alkyl group containing 2 to 18 carbon atoms interrupted by ether oxygen and $R_2$ represents hydrogen or a substituted selected halogen and hydroxyl, $C_1$ to $C_4$ alkoxy, carboxyl, $C_1$ to $C_4$ alkoxycarbonyl and phenyl groups.

2. A light-sensitive photographic material as claimed in claim 1 wherein the substituent $R_1$ represents a methyl substituted cyclohexyl group.

3. A light-sensitive photographic material as claimed in claim 1 wherein the substituent $R_1$ represents a 3,3,5-trimethylcyclohexyl group.

* * * * *